US005792267A

United States Patent [19]

Marszal et al.

[11] Patent Number: 5,792,267

[45] Date of Patent: Aug. 11, 1998

[54] COATING FIXTURE FOR A TURBINE ENGINE BLADE

[75] Inventors: Dean N. Marszal, Southington, Conn.; Russell A. Beers, Palm Beach Gardens, Fla.

[73] Assignee: United Technologies Corporation, Hartford, Conn.

[21] Appl. No.: 858,002

[22] Filed: May 16, 1997

[51] Int. Cl.[6] ..... B05C 13/00

[52] U.S. Cl. ..... 118/500; 118/504; 118/505; 118/720; 118/721; 118/728

[58] Field of Search ..... 118/720, 721, 118/728, 500, 504, 505; 204/224 R, 224 M; 205/118, 134, 135; 427/282, 448, 453–456

[56] References Cited

U.S. PATENT DOCUMENTS

| | | | |
|---|---|---|---|
| 3,207,126 | 9/1965 | Byron | 118/49 |
| 3,482,423 | 12/1969 | Murray et al. | 72/53 |
| 3,668,913 | 6/1972 | Morris | 72/53 |
| 4,530,861 | 7/1985 | Sippel et al. | 427/444 |
| 4,599,970 | 7/1986 | Peterson | 118/504 |
| 5,225,246 | 7/1993 | Beers et al. | 427/252 |
| 5,486,281 | 1/1996 | Gruver et al. | 205/110 |
| 5,565,035 | 10/1996 | Sylvestro et al. | 118/721 |
| 5,607,561 | 3/1997 | Gruver et al. | 204/224 R |

*Primary Examiner*—Laura Edwards
*Attorney, Agent, or Firm*—Kenneth C. Baran

[57] ABSTRACT

A fixture (90) for use in selectively applying a protective coating to a gas turbine engine blade (10) includes a base (92) having a blade retention slot (102), and a disposable shield (110). The shield (110) includes a sheet metal sleeve (112) and a cap (114) having a window (116) the cap being affixed to one end of the sleeve. When fully assembled with the blade properly positioned in the fixture only those portions of the blade selected to be coated are exposed. Additional features such as a locator dowel (104) extending from the floor of the slot and mutually cooperative track (121) and nub (122) assist in locating the blade correctly in the fixture and orienting the window with respect to the blade platform (16). A lock exemplified by a groove (128) and the nub (122) resists separation of the shield from the base during coating operations.

10 Claims, 3 Drawing Sheets

COATING FIXTURE FOR A TURBINE ENGINE BLADE

TECHNICAL FIELD

This invention pertains to fixtures for use in applying a protective coating to selected portions of an article such as a turbine engine blade, and more particularly to an ergonomically improved coating fixture that is both maintenance free and inexpensive to make and use.

BACKGROUND OF THE INVENTION

A modem gas turbine engine has a compressor and a turbine, each of which includes one or more arrays of blades extending radially outwardly from a rotatable hub. Each blade has a root that mates with a slot in the hub to radially retain the blade. Each blade also has a platform that partly defines the radially inner boundary of an engine flowpath, and an airfoil that extends radially across the flowpath. During engine operation a working medium gas, which flows axially through the flowpath, receives energy from the compressor blade arrays and provides energy to the turbine blade arrays.

Those portions of the blades that come in direct contact with the working medium are subjected to a punishing operational environment. This is particularly true of the turbine blades which are exposed to the elevated temperature and damaging effects of combustion products discharged from the engine's combustion chamber. Therefore it is common practice to apply various protective coatings to the flowpath exposed surfaces of the blades to extend their useful life. Application of such coatings to other portions of the blades is unnecessary, and usually undesirable as well, since the presence of a layer of coating can interfere with the installation of the blades in the hub. Accordingly, various coating fixtures have been devised to facilitate the application of a protective coating to selected portions of a blade, while shielding non-selected portions of the blade from the application of the coating. These fixtures are normally used in conjunction with a coating application apparatus such as a low pressure plasma spray coater or a physical vapor deposition coater.

Existing coating fixtures suffer from a number of shortcomings. For example one prior art fixture has a enclosure for preventing the application of the coating to the blade root and some portions of the platform while allowing the application of the coating to the airfoil and the platform surface adjacent to the airfoil. The enclosure has a removable cover that is securable to the fixture by a stud and nut arrangement. After each use, the nut and cover are manually removed so that the coated blade can be retrieved. An uncoated blade is then placed in the fixture and the cover and nut are reinstalled. Although the removal and reinstallation of the nut is not a strenuous task, a technician carrying out the operation repeatedly can develop a repetitive motion injury. The resultant costs of medical treatment and the loss of the technician's services during his or her recovery are obviously undesirable. Also noteworthy is the delay associated with removal and reinstallation of the cover and nut. Experience has shown that this delay can account for as much as 20% of the coating cycle time (i.e. the time required to apply the coating to a blade).

Another shortcoming of the above described coating fixture is the limited number of coating cycles that the fixture can support. During each coating cycle, a quantity of the coating accumulates on the fixture itself. After a number of coating cycles, further use of the fixture results in the formation of a coating "bridge" between the fixture and the blade platform.

Once this bridge is established, it is difficult to remove the blade from the fixture without chipping the coating from the platform and rendering the blade unsuitable for service. The blade must then be stripped and recoated. To avoid the need to strip and recoat blades, each fixture is used only a limited number of times and then is temporarily removed from service and refurbished by stripping the accumulated coating from the fixture with an acidic solution. This maintenance of the fixture is time consuming and costly, is and the used acid solution is a hazardous waste that must be, disposed of at considerable expense. Moreover, because each fixture is serviceable for only a limited number of coating cycles, a large inventory of fixtures must be on hand so that the supply of serviceable fixtures is sufficient to support lengthy, uninterrupted production runs.

Thus it is seen that conventional coating fixtures are ergonomically imperfect, are expensive and inconvenient to maintain, and contribute to the generation of hazardous waste. In view of these shortcomings, an ergonomically superior, maintenance free and inexpensive coating fixture is sought.

SUMMARY OF THE INVENTION

It is, therefore, an object of the invention to provide a coating fixture that reduces the risk of repetitive motion injuries to technicians carrying out coating operations.

It is another object to minimize the generation of hazardous waste by providing a coating fixture that is as maintenance free as possible.

It is yet another object of the invention to minimize the inventory of costly fixtures necessary to support lengthy, uninterrupted production runs.

According to the invention, a coating fixture includes a reusable base with a receptacle for holding a turbine engine blade, and an inexpensive, disposable shield that enshrouds the base and those portions of the airfoil which are to be shielded from the application of the coating.

In one specific embodiment of the invention, the shield is a sleeve with a cap affixed to one of its ends. The sleeve slides over the base so that a window in the cap borders the blade platform. The shield exposes the airfoil and the adjacent platform surface to the application of the coating while shielding the root, other portions of the platform and the base from the application of the coating.

A primary advantage of the invention is that the shield is easily and quickly removable and installable so that the likelihood of repetitive motion injuries is reduced and the pace of coating operations is accelerated.

Another advantage is that the shield is inexpensive and therefore disposable. Disposing of used shields eliminates the generation of hazardous waste arising from the acid stripping of conventional fixtures.

A further advantage is that the invention dispenses with the need to have a large inventory of expensive fixtures. With the fixture of the present invention, uninterrupted production can be carried out with only a small quantity of fixture bases and a larger quantity of inexpensive, disposable shields.

The foregoing features and advantages and the operation of the invention will become more apparent in light of the following description of the best mode for carrying out the invention and the accompanying drawings.

BEST MODE FOR CARRYING OUT THE INVENTION

Figure 1:
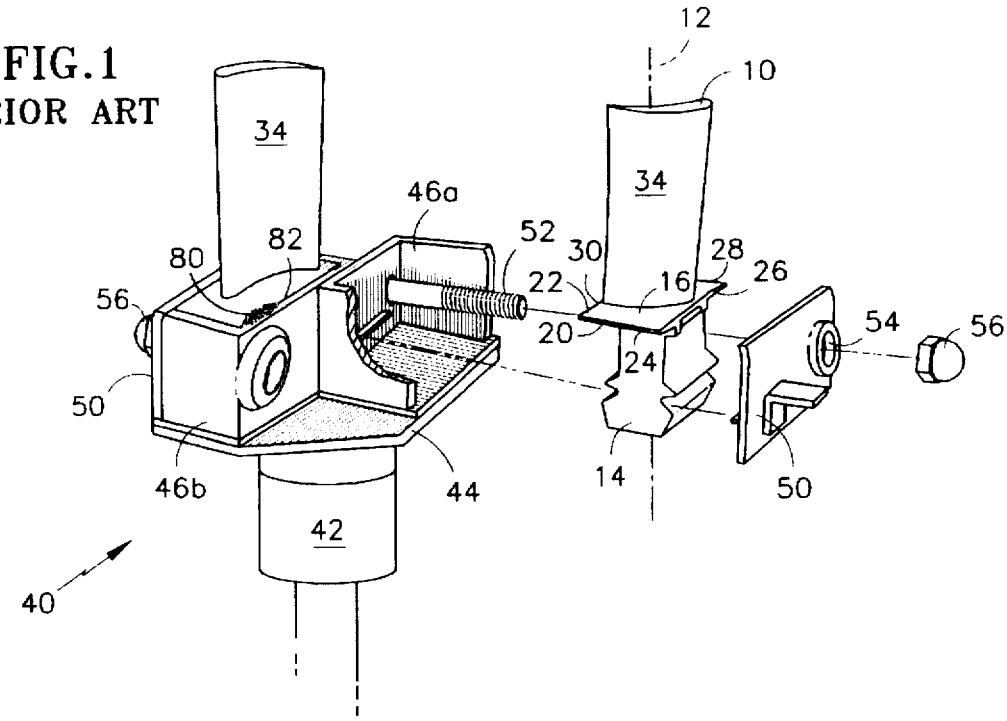
FIG.1 PRIOR ART
FIG. 1 is a perspective view of a turbine engine blade and a prior art coating fixture partly disassembled for insertion or retrieval of the blade.
Figure 2:
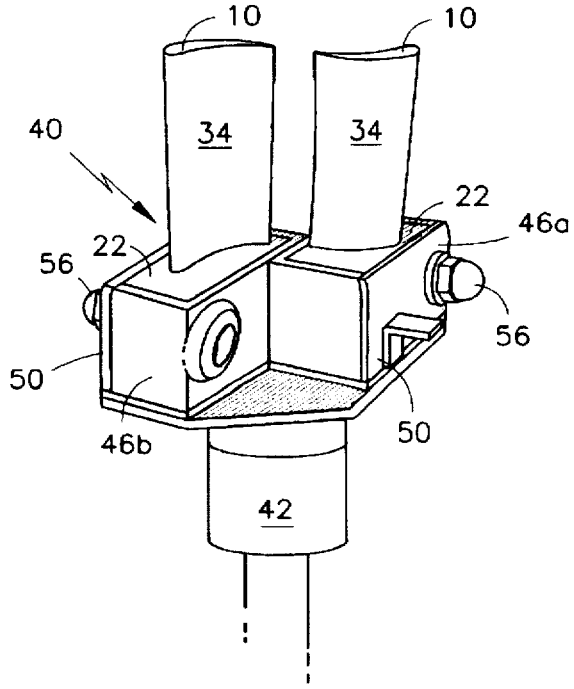
FIG.2 PRIOR ART
FIG. 2 is a perspective view of the blade and coating fixture of FIG. 1 showing the fixture in a fully assembled state.

The construction, operation and advantages of the present invention are best appreciated by first examining a gas turbine engine turbine blade and a conventional coating fixture as seen in FIGS. 1 and 2. The blade 10 has a spanwise axis 12 and includes a root 14 having a conventional "fir tree" shape, a platform 16 having an inner surface 20, an outer surface 22 and peripheral faces 24, 26, 28, 30 extending between the surfaces, and an airfoil 34. When installed in a gas turbine engine, the blade root mates with a similarly shaped fir-tree slot in a rotatable hub so that the blade projects radially outwardly from the hub. The platform cooperates with platforms of adjacent blades installed in the hub to define the radially inner boundary of an engine flowpath. The airfoil extends radially across the flowpath so that both the airfoil and the outer surface 22 of the platform are directly exposed to the damaging influences of a working medium gas flowing through the flowpath. The root, the platform inner surface and the faces are not directly exposed to the working medium.

FIGS. 1 and 2 also illustrate a conventional coating fixture 40 for applying a protective coating, such as a thermally insulating, oxidation resistant or corrosion resistant coating to the airfoil and the platform outer surface. The illustrated fixture is capable of holding two blades at a time. The fixture includes a shank 42, a base 44 and a pair of enclosures **46*a*, 46*b*, each of which has a removable cover 50. A threaded stud 52 passes through the enclosure and through a hole 54 in the cover so that the cover can be secured to the fixture by a nut 56. When fully assembled with the blade properly positioned in the fixture (FIG. 2) only the portions of the blade selected to be coated, specifically the airfoil 34 and the platform outer surface 22**, are exposed.

Figure 3:
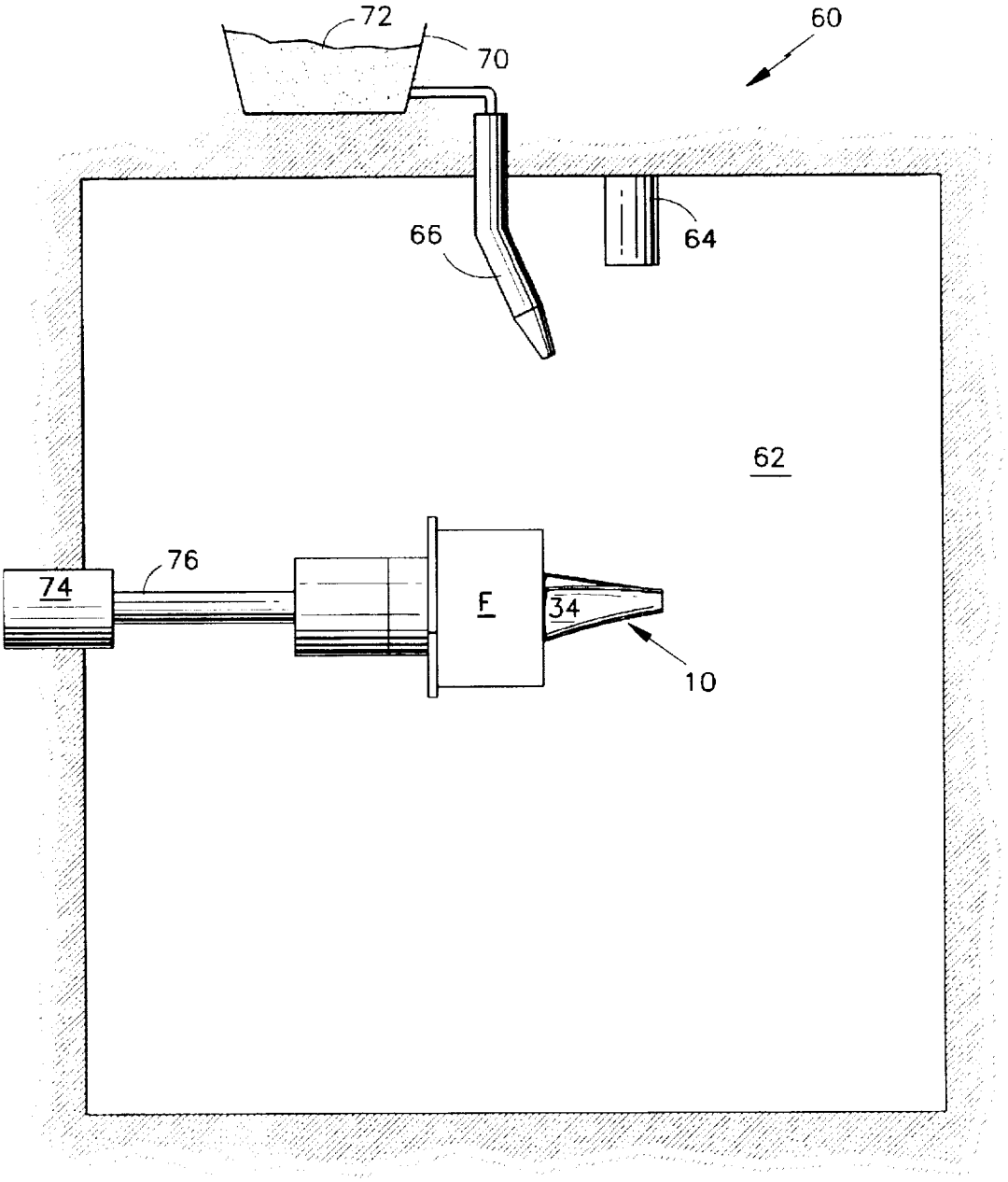
FIG. 3 is a schematic side view of a coating apparatus used in conjunction with a prior art coating fixture or a with coating fixture of the present invention.

The coating fixture is used in conjunction with a conventional coating application apparatus such as the low pressure plasma spray (LPPS) coater 60 shown in FIG. 3. The coater includes a vacuum chamber 62 with a plasma spray gun 64 and a nozzle 66 projecting through one wall of the chamber. The nozzle is connected to a hopper 70 containing a supply of powder metal 72. A gripper 74 also extends into the interior of the chamber. One end of a shaft 76 is removably connected to the gripper and a suitable coating fixture, indicated generically as F, is removably connected to the other end of the shaft. The coating fixture F may be a prior art fixture, such as that shown in FIGS. 1 and 2, or may be a fixture according to the present invention as described hereinafter. During coating operations, the gun 64 generates a high temperature flame which vaporizes metal particles metered through the nozzle. The resultant metallic mist coats the exposed portions of the blade 10 and accumulates on the fixture as well. An example of a powder metal used in the above described coater is one comprised primarily of nickel with significant amounts of cobalt, chromium and aluminum. Such a material, when deposited as a coating on the selected surfaces of a turbine blade, forms a corrosion and oxidation resistant barrier and serves as a foundation for the subsequent application of a ceramic thermal barrier coating.

Once the blade is adequately coated, a technician disconnects the shaft from the gripper and removes the shaft, with the fixture F still attached, from the coater. If the fixture F is of the type shown in FIGS. 1 and 2, the technician then removes the nut 56, and retrieves the coated blades. Uncoated blades are then placed in the fixture and the technician reinstalls the cover and nut and returns the shaft and fixture to the coater. Numerous repetitions of the above described sequence increases the risk that the technician will develop a repetitive motion injury. Moreover, the removal and reinstallation of the cover and nut can account for as much as 20% of the coating cycle time.

If the fixture of FIGS. 1 and 2 is used too many times, the coating that has accumulated on the fixture acts in concert with freshly deposited coating to form a "bridge" 80 across the seams 82 between the walls of the enclosure 46 and the margins of the platform outer surface. Once such a bridge has formed, it is difficult to remove the blade from the fixture without chipping the coating from the platform and rendering the blade unsuitable for service. Each fixture is therefore used only a limited number of times and then is temporarily removed from service and refurbished by stripping the accumulated coating from the fixture with an acidic solution. This maintenance of the fixture is time consuming and costly, and the used acid solution is a hazardous waste that must be disposed of at considerable expense. Moreover, because each fixture is serviceable for only a limited number of coating cycles, a large inventory of fixtures must be on hand so that the supply of serviceable fixtures is sufficient to support lengthy, uninterrupted production runs.

Figure 4:
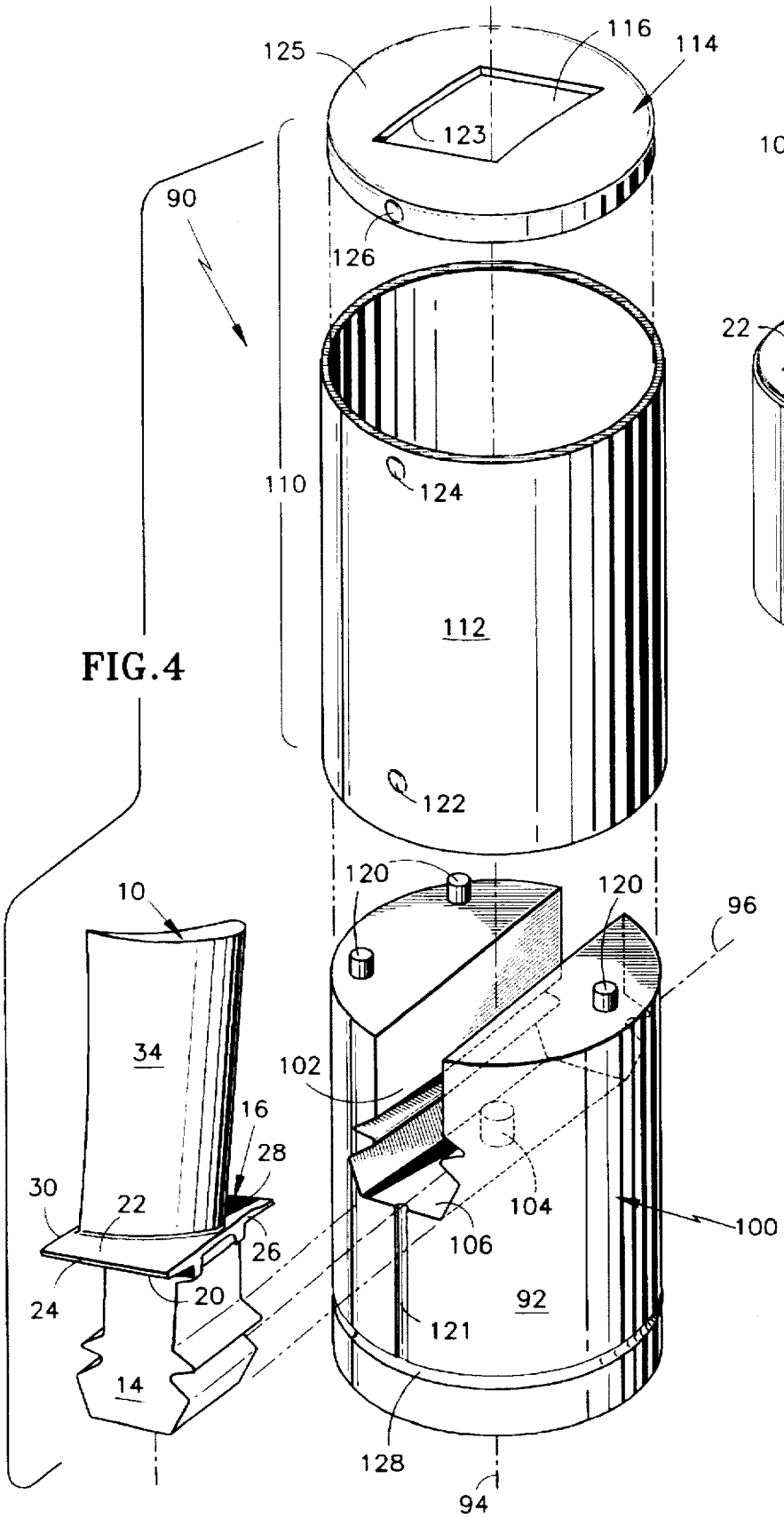
FIG. 4 is a perspective view of a turbine engine blade and a coating fixture of the present invention partly disassembled for insertion or retrieval of the blade.
Figure 5:
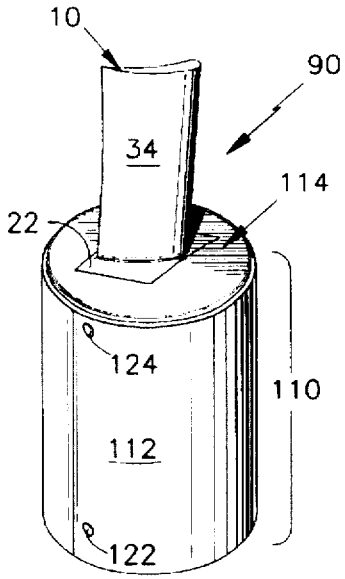
FIG. 5 is perspective view of the blade and coating fixture of FIG. 4 showing the future in a fully assembled state.

Referring now to FIGS. 4 and 5, a coating fixture 90 according to the present invention includes a base 92 having a longitudinal axis 94, a lateral axis 96 and a receptacle 100 for receiving and holding a blade by its root 14. In the illustrated embodiment the receptacle is a slot 102 extending laterally in the base. The slot extends to the periphery of the base and is substantially conformal with the blade root. That is, the shape and size of the slot mimics the shape and size of the blade root. A blade locator such as dowel 104 projects longitudinally from the floor 106 of the slot.

The fixture also includes a removable, disposable shield 110 which, when installed on the base 92 (FIG. 5) enshrouds the base and at least a portion of the blade thereby protecting against the application of the coating to the base and the enshrouded blade portion while also exposing at least the airfoil to the application of the coating. The shield includes sheet metal sleeve 112 with a cap 114 affixed to one end of the sleeve. The shield is longitudinally sidable with respect to the base, and the cap has a window 116 substantially congruent to the blade platform. Although the cap may be permanently affixed to the sleeve, the cap of the illustrated embodiment is separably affixed to the end of the sleeve by a light interference fit between the cap and the sleeve.

The fixture also includes a translation limiter such as posts 120 extending longitudinally from the base. When the shield is installed over the base, the posts bear against inner surface 123 of the cap to limit translation of the shield relative to the base. This ensures that outer surface 125 of the cap 114 is substantially flush with the outer surface 22 of the platform as best seen in FIG. 5. As a result, the blade root 14, the platform inner surface 20 and the platform peripheral faces 24, 26, 28, 30 are enshrouded by the shield while the platform outer surface and the airfoil are exposed.

The fixture may also include a guide for orienting the shield, 110 and therefore the window 116, relative to the blade platform. The guide comprises a recessed track 121 extending longitudinally along the exterior surface of the base and a cooperating projection such as nub 122 on the interior surface of the sleeve. The sleeve may also include a second, inwardly projecting nub 124 that is circumferentially aligned with nub 122. When the cap is assembled to the sleeve, nub 124 snaps into a dimple 126 on the cap so that the window is properly aligned with the sleeve and therefore with the blade platform 16.

The fixture may also include a lock to resist separation of the shield from the base. The lock comprises a depression such as circumferentially extending groove 128 at the lower end of the track 121 and a cooperating projection such as the nub 122. Preferably the groove 128 is deeper than the track 121 so that the nub 122 snaps into place in the groove thereby positively locking the shield to the base. The snapping action also provides tactile feedback to signify that the shield is, in fact, properly locked in place. A lock may be unnecessary when the fixture is oriented in a coater so that its longitudinal axis 94 is vertical. However in some coaters the fixture must be oriented so that its longitudinal axis is horizontal. In these cases, the lock is beneficial for keeping the shield securely in place.

The fixture may be made of any material or combination of materials capable of withstanding the elevated temperatures in the interior of the coating chamber. For example stainless steel such as AMS 5513 or AMS 5524 are suitable for the sheet metal cap and sleeve. Stainless steel such as AMS 5639 or AMS 5648, or a nickel base alloy such as AMS 5596, AMS 5708, AMS 5390 (Hastelloy X) or AMS 5383 (Inconel 718) are suitable for the base 92.

To use the fixture 90, the technician merely slides an uncoated blade 10 laterally into the slot 102 until the blade root contacts the dowel 104. The contact between the blade root and the dowel ensures lateral alignment of the blade platform with the window 116 in the cap. The shield is then installed over the base by aligning the nub 122 with the track 121 and sliding the shield longitudinally over the base until the posts 120 resist further translation of the shield and the nub 122 snaps into the locking groove 128. Once the coating operation is complete, the coated blade is retrieved by reversing the above sequence.

As is evident from the foregoing description, the fixture significantly reduces the repetitive motions associated with the bolted cover of the prior art fixture (FIGS. 1 and 2). Since the shield is easily installable and removable without tools, the time required to retrieve a coated blade and replace it with an uncoated blade is also reduced. To prevent the problem of bridging, the shield is periodically replaced with a new shield. Because the shields are inexpensive, used shields are discarded rather than refurbished. This practice eliminates the hazardous waste generated during refirbishment and also eliminates the need to have a large inventory of expensive fixtures to support sustained production runs. With the fixture of the present invention all that is required is a small quantity of reusable fixture bases and a large inventory of the relatively inexpensive shields. In the preferred embodiment of the invention, the shield has a cap that is separable from the sleeve. Therefore further cost savings may be realized by periodically replacing only the used caps and reusing the sleeve.

Various changes and modifications can be made without departing from the invention as set forth in the accompanying claims. For example, the base 92 can include multiple receptacles 100 so that two or more blades may be simultaneously coated with a single fixture. Moreover, although the use of the invention has been described in the context of low pressure plasma spray coating, its utility extends to other types of coating processes where it is desirable to mask a portion of the blade.

We claim:

1. A fixture for selectively applying a coating to a gas turbine engine blade, the blade having a root, a platform and an airfoil, the platform having inner and outer surfaces and peripheral faces extending between the surfaces, the fixture comprising:

a base having a receptacle for holding the blade; and a removable shield which enshrouds the base and at least a portion of the blade to protect against the application of the coating to the base and the enshrouded blade portion, the shield also exposing at least the airfoil to the application of the coating.

2. The fixture of claim 1 wherein the receptacle comprises a slot in the base, the slot being substantially conformal with the blade root.

3. The fixture of claim 2 further comprising a locator for locating the blade in the slot.

4. The fixture of claim 1 wherein the base has a longitudinal axis and the shield comprises a sleeve and a cap affixed to an end of the sleeve, the shield being longitudinally slidable with respect to the base, the cap having a window substantially congruent to the blade platform, the fixture having a limiter to limit translation of the shield relative to the base so that the enshrouded portion of the blade is the root, the platform inner surface and the platform peripheral faces and the exposed portion of the blade is the platform outer surface and the airfoil.

5. The fixture of claim 4 wherein the cap is separably affixed to the end of the sleeve.

6. The fixture of claim 4 wherein the translation limiter is a post extending longitudinally from the base.

7. The fixture of claim 4 further comprising a guide for orienting the window relative to the blade platform.

8. The fixture of claim 7, wherein the guide comprises a recessed track extending longitudinally in the exterior surface of the base and a cooperating projection on the interior surface of the sleeve.

9. The fixture of claim 4 further comprising a lock for resisting separation of the shield from the base.

10. The fixture of claim 9 wherein the lock comprises a depression in the exterior surface of the base and a cooperating projection on the interior surface of the sleeve.

* * * * *